US008231367B2

(12) United States Patent
Suefuji et al.

(10) Patent No.: US 8,231,367 B2
(45) Date of Patent: Jul. 31, 2012

(54) COMPRESSOR HAVING A SIMPLIFIED STRUCTURE WITH A REDUCED SIZE

(75) Inventors: Kazutaka Suefuji, Kanagawa (JP); Shunsuke Mori, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 830 days.

(21) Appl. No.: 12/318,202

(22) Filed: Dec. 23, 2008

(65) Prior Publication Data

US 2009/0169405 A1 Jul. 2, 2009

(30) Foreign Application Priority Data

Dec. 28, 2007 (JP) ..... 2007-339332

(51) Int. Cl.
*F04B 49/00* (2006.01)
*F04B 53/00* (2006.01)

(52) U.S. Cl. ..... 417/559; 417/437; 417/310; 417/279; 417/440

(58) Field of Classification Search ..... None
See application file for complete search history.

(56) References Cited

U.S. PATENT DOCUMENTS 6,893,229 B2 * 5/2005 Choi et al. ..... 417/310
7,094,038 B2 * 8/2006 Choi ..... 417/310
7,771,178 B2 * 8/2010 Perevozchikov et al. ..... 417/440

FOREIGN PATENT DOCUMENTS

JP 58-220988 A 12/1983
JP 10-325396 A 12/1998
JP 2004-360644 A 12/2004

OTHER PUBLICATIONS

English machine translation of JP 2004-360644 (Tsukamoto).*
Chinese Office Action dated Apr. 27, 2010 (Eight (8) pages).

* cited by examiner

*Primary Examiner* — Natalie Walford
(74) *Attorney, Agent, or Firm* — Crowell & Moring LLP

(57) ABSTRACT

There is provided with a compressor comprising: a compressor main body in which fluid inhaled from an inhale port is compressed, and the compressed fluid is exhausted from an exhaust port; and a pressure retaining device where provided on the exhaust port side of the compressor main body, and retaining pressure on the exhaust port side, wherein the pressure retaining device comprises: a valve body communicating with the exhaust port; an urging member normally urging the valve body into a direction to be closed; and a back-pressure means where an intermediate pressure between the inhale port and the exhaust port of the compressor main body is introduced as back pressure which affects the valve body, and wherein the valve body of the pressure retaining device is openable according to difference between pressure at the exhaust port, and the intermediate pressure of the back-pressure means and force by the urging member.

20 Claims, 8 Drawing Sheets

COMPRESSOR HAVING A SIMPLIFIED STRUCTURE WITH A REDUCED SIZE

BACKGROUND OF THE INVENTION

1. Field of the Invention

The present invention relates to a compressor for a scroll fluid apparatus, etc., and more particularly to a compressor suitably used for compressing fluid such as air.

2. Description of the Related Art

In conventional compressors in which to compress fluid such as air, the following scroll compressor has been known. That is, by driving an orbiting scroll to orbit relative to a fixed scroll by means of a driving source such as an electric motor, fluid is compressed sequentially in a compressed chamber placed between both of the scrolls (refer to, for example, Japanese Patent Application Laid-open No. H10-325396).

The conventional scroll compressor of this kind is provided with a back-pressure chamber where either one of the scroll members, the fixed scroll or the orbiting scroll, is pressed against the other scroll member. The scroll compressor can adjustably control pressure within the back-pressure chamber according to pressure of compressed fluid exhausted from the compressed chamber, whereby tip clearance of lap portions for both the fixed scroll and the orbiting scroll can be properly secured.

Here, in the scroll compressor with conventional technologies discussed above, the compressor only has a special back-pressure chamber on a rear side of the fixed scroll or the orbiting scroll and only adjustably control pressure within the back-pressure chamber according to pressure of an exhaust fluid (compressed fluid). Accordingly, until the pressure of the exhaust fluid is increased at an initial starting stage of the compressor, the pressure of the back-pressure chamber can not be controlled, whereby behavior of the orbiting scroll may be unstable.

Further, since the conventional scroll compressor is configured as that the special back-pressure chamber is provided on the rear side of the fixed scroll or the orbiting scroll, it is necessary to secure an additional space for the back-pressure chamber within a casing of the scroll compressor. With this, the overall architecture of the scroll compressor becomes complicated and enlarged in size, whereby it makes difficult to achieve small-size and weight-saving.

SUMMARY OF THE INVENTION

The present invention has been made in light of the above problem, and it is an object of the present invention to provide an compressor where being able to, for example, stabilize compressive operation at starting, etc., simplify its architecture, and achieve small-size and weight-saving of the overall architecture thereof.

In order to achieve the object described above, according to a first aspect of the present invention, there is provided a compressor comprising: a compressor main body in which fluid inhaled from an inhale port is compressed, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage side where communicating with the exhaust port; an urging member where normally urging the valve body into a direction to be closed; and a back-pressure means where an intermediate pressure between the inhale port and the exhaust port of the compressor main body is introduced as back pressure which affects the valve body, and wherein the valve body of the pressure retaining device is openable according to difference between pressure at the exhaust port, and the intermediate pressure of the back-pressure means and force by the urging member.

According to a second aspect of the present invention, there is provided a compressor comprising: a scroll compressor main body where, while each of lap portions for two scroll members is superimposed on each other and performs orbiting motion, fluid inhaled from an inhale port is compressed in a compression chamber, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage where communicating with the exhaust port; an urging member where normally urging the valve body into a direction to be closed; and a back-pressure means where an intermediate pressure between the inhale port and the exhaust port of the compressor main body is introduced as back pressure which affects the valve body, and wherein the valve body of the pressure retaining device is openable according to difference between pressure at the exhaust port, and the intermediate pressure of the back-pressure means and force by the urging member.

According to a third aspect of the present invention, there is provided a compressor comprising: a scroll compressor main body where, while each of lap portions for two scroll members is superimposed on each other and performs orbiting motion, fluid inhaled from an inhale port is compressed in a compression chamber, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage where communicating with the exhaust port; an urging member where normally urging the valve body into a direction to be closed; and a back-pressure means including a back-pressure chamber which applies a pressure as a back pressure to the valve body in a direction to close the valve body and a back-pressure passage which introduced an intermediate pressure between the inhale port and the exhaust port of the compressor main body into the back-pressure chamber as back pressure, and wherein the valve body of the pressure retaining device is openable according to difference between pressure at the exhaust port, and the intermediate pressure of the back-pressure chamber and force by the urging member.

As discussed above, according to the present invention, the valve body of the pressure retaining device which retains pressure on the exhale port side of the compressor main body is structured as that the valve body is to be opened when pressure by the compressed fluid on the exhale port side goes beyond the intermediate pressure (or back pressure) of the back-pressure means and the urging force of the urging means. Accordingly, when the compressor main body is started, the valve body is to be closed by means of the intermediate pressure and the urging force of the urging member, whereby pressure retaining functions which holds pressure of the compressor main body on the exhaust port side can be well displayed. Furthermore, in a state where pressure (exhaust pressure) of the compressed fluid is raised so as to go beyond the value of the intermediate pressure and the urging pressure, it is possible to open the valve body so as to exhaust the compressed fluid to reservoir, etc. externally installed. Accordingly, the present invention can not only achieve simplification of the structure of the compressor but also succeed in miniaturization and lightweight of the compressor as a whole. Furthermore, the present invention can stabilize compression performance, for example, when started.

DETAILED DESCRIPTION OF THE PREFERRED EMBODIMENTS

Hereinafter, a compressor according to embodiments of the present invention will be discussed in detail with reference to accompanying drawings. Cases where applied to a scroll compressor will be exemplified.

Figure 1:
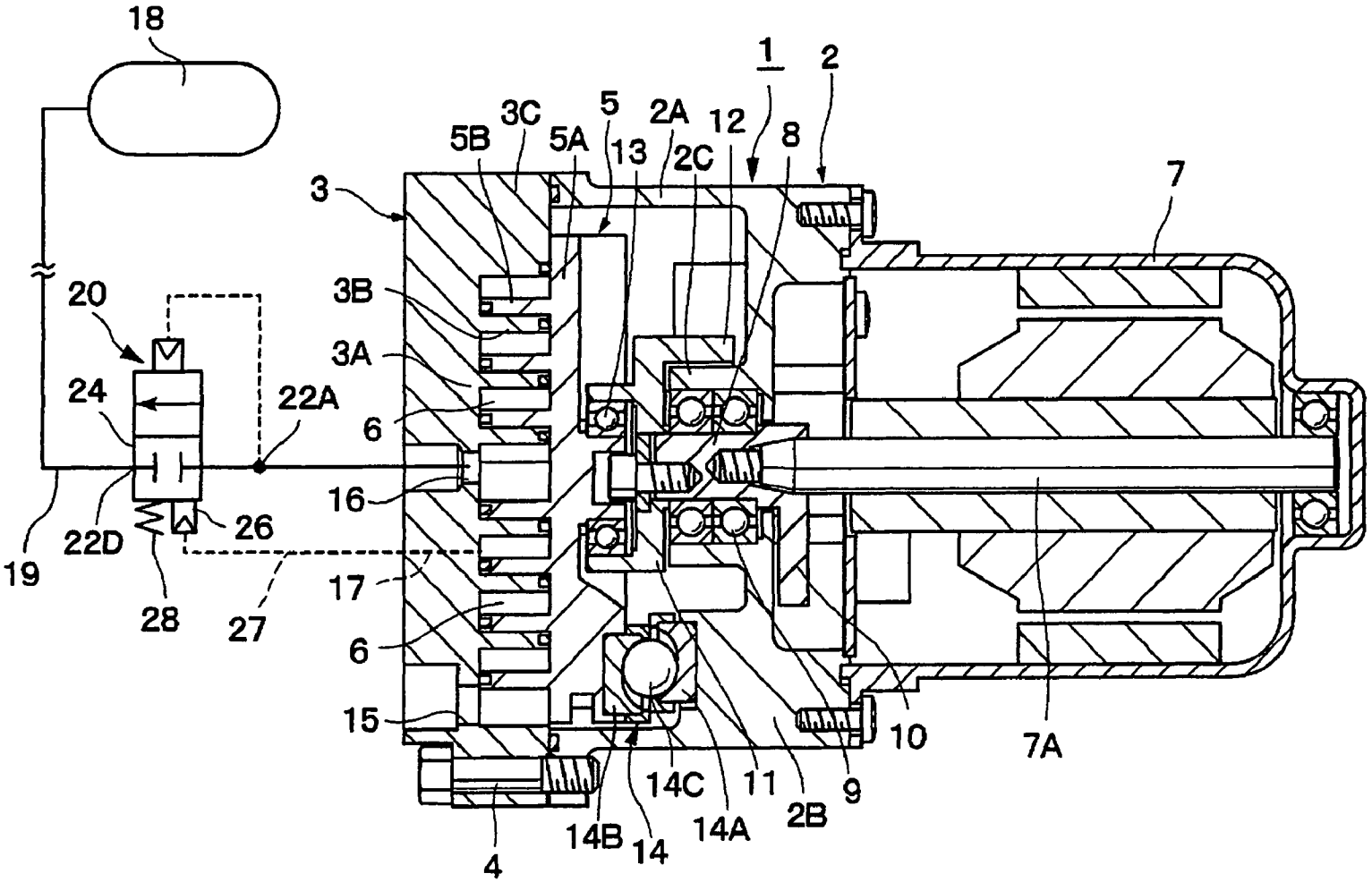
FIG. 1 is an overall schematic view showing a compressor according to a first embodiment of the present invention.
Figure 2:
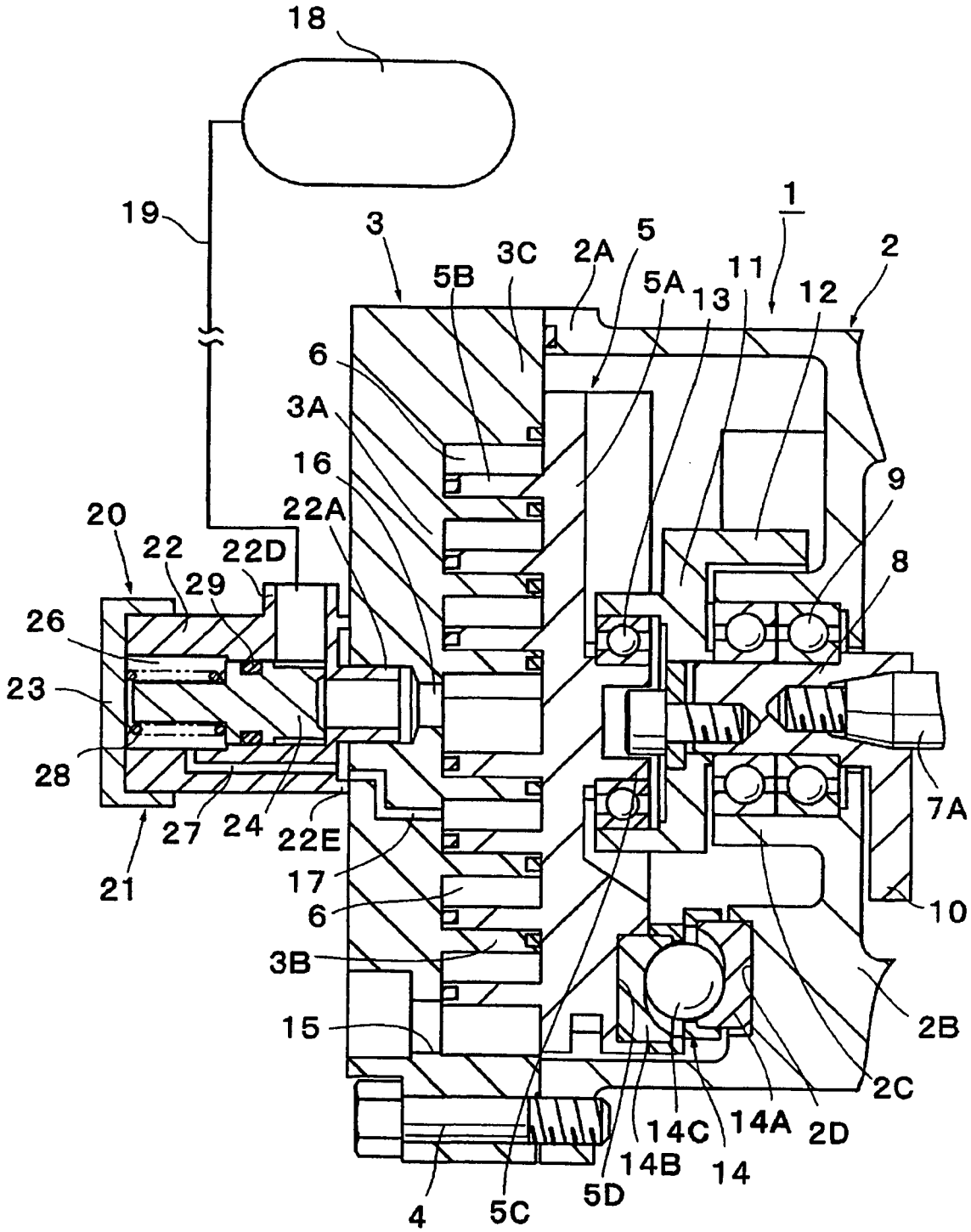
FIG. 2 is a longitudinal-sectional view showing a state where a pressure retaining valve in FIG. 1 is mounted in a fixed scroll of a compressor main body.
Figure 3:
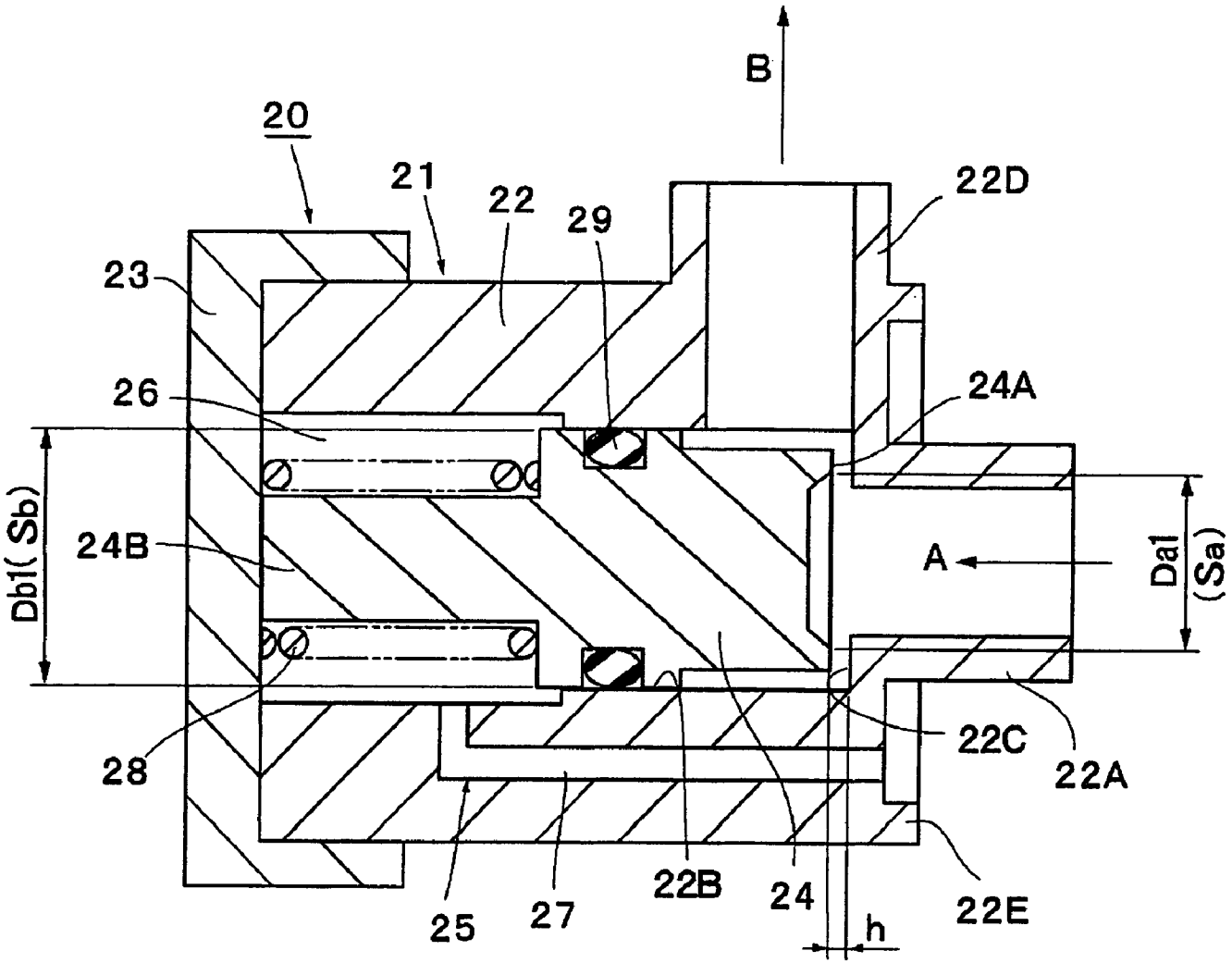
FIG. 3 is an expanded cross-sectional view showing a state where the pressure retaining valve in FIG. 2 is opened.

In FIGS. 1 to 3, a first embodiment of the present invention is shown. In these figures, a reference numeral 1 shows a compressor main body where applied with a scroll compressor. The compressor main body 1 mainly comprises: a casing 2, a fixed scroll 3, an orbiting scroll 5, an electric motor 7, an eccentric bushing 11, a balance weight 12 and a rotation prevention device 14, the details of which are explained hereinafter.

The casing 2 where configuring an outer shell of the compressor main body 1 is detachably provided with the electric motor 7 explained hereinafter on one side (right side in FIG. 1) of the casing 2 in its axial direction. See FIG. 1. On the other side (left side in FIG. 1) in the axial direction, the casing 2 has an opening so that the casing 2 is formed into a closed-end tubed body. That is, the casing 2 comprises: a cylinder portion 2A having an opening on the other side of the casing 2 in the axial direction (i.e., on the fixed scroll 3 side hereinafter explained); a circular bottom portion 2B integrally formed on one side of the cylinder portion 2A in its axial direction and extended inward in a radius direction; and a tubed bearing mounting portion 2C extended from an inner periphery side of the bottom portion 2B to the other side in the axial direction of the casing 2A.

Within the cylinder portion 2A of the casing 2 comprises: the orbiting scroll 5, the eccentric bushing 11, the balance weight 12 and the rotation prevention device 14, etc., the details of which are explained hereinafter. Further, on the side of the bottom portion 2B of the casing 2, a plurality of pedestal portions 2D (only one is shown in FIG. 1) hereinafter explained are provided wherein the pedestal portions 2D receive a thrust load in the axial direction of the casing 2, which applies to the orbiting scroll 5, via the rotation prevention device 14. These pedestal portions 2D are arranged in the circumference direction of the casing 2 at regular intervals.

Reference numeral 3 indicates the fixed scroll as a scroll member where fixedly provided on the opening end side of the casing 2 (or the cylinder portion 2A). The fixed scroll 3, as shown in FIGS. 1 and 2, mainly comprises: an end plate 3A, formed into a circular disc; a spiral lap portion 3B provided so as to stand on a front surface of the end plate 3A; and a tube-shaped supporting portion 3C where provided on an outer periphery side of the end plate 3A so as to externally surround the lap portion 3B in a radius direction, and fastened on the opening end side of the casing 2 (or the cylinder portion 2A) by means of a plurality of bolts 4, etc.

Reference numeral 5 indicates the orbiting scroll where provided so as to face the fixed scroll 3 in the axial direction of the casing 2, and rotationally provided in the casing 2. The orbiting scroll 5, as shown in FIGS. 1 and 2, mainly comprises: an end plate 5A, formed into a circular disc; a spiral lap portion 5B provided so as to stand on a front surface of the end plate 5A; and a tube-shaped boss portion 5C where provided so as to stand on a back surface side of the end plate 5A (the opposite side where the lap portion 5B is provided), and installed in the eccentric bushing 11 later described via a orbiting bearing 13.

Further, on an external diameter side of a back surface of the orbiting scroll 5, a plurality of installing portions 5D (only one is shown in FIG. 2), on which a later-described thrust seat 14B of the rotation prevention device 14 is fitted, are provided at regular intervals in a circumferential direction of the orbiting scroll 5. These installing portions 5D are each arranged at positions where facing the pedestal portions 2D of the casing 2 in its axial direction.

Here, the boss portion 5C of the orbiting scroll 5 has its center arranged so as to be eccentric in a radius direction relative to a center of the fixed scroll 3 only for a predetermined dimension (turning radius). In this state, the lap portion 5B of the orbiting scroll 5 is arranged in a manner on which the lap portion 3B of the fixed scroll 3 is superimposed. Between the lap portion 3B and the lap portion 5B, a plurality of compression chambers 6 are formed.

The orbiting scroll 5 is driven by the electric motor 7 later described via a rotating shaft 8 and the eccentric bushing 11, and performs orbiting motion relative to the fixed scroll 3 in a state where restricted to rotate by means of the rotation prevention device 14 later described. With this, compression chambers 6 placed on the external diameter side among the plurality of the compression chambers 6 inhale air from an inhale port 15 later described, so that the air is compressed in a sequential manner within each of the compression chambers 6. The compression chambers 6 placed on the inner diameter side exhaust the compressed air outside from an exhaust port 16 later described.

Reference numeral 7 indicates the electric motor as a driving source which orbitably drives the orbiting scroll 5. This electric motor 7 orbitably drives a driving shaft 7A extended in its axial direction. Here, the driving shaft 7A of the electric motor 7 has a tip end side where extended toward the bottom portion 2B of the casing 2, wherein, as shown in FIG. 2, the tip end side of the driving shaft 7A is integrally connected with the rotating shaft 8 later described.

Reference numeral 8 indicates the rotating shaft rotatively provided within the bearing mounting portion 2C of the casing 2 via a bearing 9, wherein, as shown in FIG. 1, the rotating shaft 8 has a base end to which the driving shaft 7A of the electric motor 7 is detachably installed. The rotating shaft 8 is driven to rotate by means of the electric motor 7. Further, the tip end side of the rotating shaft 8 is orbitably connected with the boss portion 5C of the orbiting scroll 5 via the eccentric bushing 11 and the orbiting bearing 13.

Still further, the base end of the rotating shaft 8 is, as shown in FIG. 2, integrally provided with a sub-weight 10 extended outward in the radius direction of the casing 2. This sub-weight 10 functions to counteract external force in a direction where making the rotating shaft 8, etc. inclined with centrifugal force each generated when the balance weight 12 and the orbiting scroll 5 rotate.

Reference numeral 11 indicates the eccentric bushing, formed into a stepped cylinder, provided on the tip end side of the rotating shaft 8. The eccentric bushing 11 on the side of the boss portion 5C of the orbiting scroll 5 is eccentrically connected with the rotating shaft 8 via the orbiting bearing 13 later explained. The eccentric bushing 11 rotates along with the rotating shaft 8 so as to convert the rotation into orbiting motion of the orbiting scroll 5. Here, an outer periphery side of the eccentric bushing 11 is integrally provided with the balance weight 12 for stabilizing orbiting motion of the orbiting scroll 5.

Reference numeral 13 indicates the orbiting bearing arranged between the boss portion 5C of the orbiting scroll 5 and the eccentric bushing 11, wherein the orbiting bearing 13 orbitably supports the boss portion 5C of the orbiting scroll 5 relative to the eccentric bushing 11. Accordingly, this structure compensates that the orbiting scroll 5 can perform orbiting motion with a predetermined orbiting radius relative to the axis of the rotating shaft 8.

Reference numeral 14 indicates a plurality of the rotation prevention devices provided between the bottom portion 2B of the casing 2 and a back surface side of the orbiting scroll 5, wherein each of the rotation prevention devices is composed of so-called ball-coupling mechanism. This rotation prevention devices are adapted to prevent rotation of the orbiting scroll 5 via thrust points 14A, 14B, a ball 14C, etc., the detail of which are explained later, and to receive thrust load. Further, those rotation prevention devices are arranged between each of the pedestal portions 2D of the casing 2 and each of the installing portions 5D of the orbiting scroll 5.

To be more specific, each of the rotation prevention devices 14 composed of a ball coupling comprises, as shown in FIG. 2: a first thrust point 14A provided so as to fix to each side of the pedestal portions 2D of the casing 2; a second thrust point 14B where facing the first thrust point 14A in the axial direction of the casing and provided on each side of the installing portions 5D of the orbiting scroll 5; and a spherical ball 14C rotationally provided between the first and second thrust points 14A, 14B.

Further, the ball 14C of the rotation prevention devices 14 is formed into sphere and made of material having high rigidity such as steel balls, whereby the ball 14C will receive thrust load applied to, for example, the end plate 5A of the orbiting scroll 5, together with the first and second thrust points 14A, 14B on the pedestal portion 2D side of the casing 2.

Reference numeral 15 indicates the inhale port provided on an outer periphery of the fixed scroll 3. This inhale port 15 inhales air from exterior via air-suction filters (not shown), etc., and the air inhaled is continuously compressed along with orbiting motion of the orbiting scroll 5 within each of the compression chambers 6.

Reference numeral 16 indicates the exhaust port provided at center of the fixed scroll 3. This exhaust port 16 exhausts compressed air from the compressed chamber 6, where placed at the most center in a radius direction of the cylinder 2 (hereinafter the most-centered compression chamber 6), to a later-explained reservoir 18. Relative to the most-centered compression chamber 6, the compression chamber 6, which is positioned at a place farthest from the exhaust port 16 in a radius direction, is hereinafter referred to as the most-peripheral compression chamber 6.

Reference numeral 17 indicates an intermediate-pressure passage provided at the fixed scroll 3, wherein the intermediate-pressure passage 17 is, as shown in FIG. 2, extended in a plate-thickness direction of the end plate 3A, and communicates with one of the compression chambers 6 placed between the most-centered compression chamber 6 and the most-peripheral compression chamber 6. Further, the intermediate-pressure passage 17 is connected with a back-pressure passage 27 of a later-described pressure retaining valve 20 where placed on a back side of the end plate 3A. Still further, the intermediate-pressure passage 17 introduces intermediate pressure taken at a position between the inhale port 15 and the exhaust port 16 of the compressor main body 1 into the pressure retaining valve 20 side as back pressure.

Reference numeral 18 indicates the reservoir which reserves compressed air as compressed fluid, wherein the reservoir 18 is arranged at a place where apart from the compressor main body 1. The reservoir 18 is connected with a discharge port 22D of the pressure retaining valve 20 via a conduit 19, etc. The reservoir 18 will temporarily reserve compressed air exhausted from the compressed chamber 6 of the compressor main body 1 via the exhaust port 16 and the pressure retaining valve 20. The compressed air in the reservoir 18 is to be supplied to, for example, an air compressor (not shown) provided outside, as compressed-air source.

Reference numeral 20 indicates the pressure retaining valve composed of pressure retaining devices where provided on the discharge port side of the compressor main body 1. The pressure retaining valve 20 comprises: a valve case 21; a valve body 24; back-pressure chamber 26; and a compression spring 28. The pressure retaining valve 20 opens/closes the valve body 24, so that the exhaust port 16 of the compressor main body 1 (or the fixed scroll 3) is communicated or intercepted with the reservoir 18.

Reference numeral 21 is the valve case which constitutes an outer shell of the pressure retaining valve 20. This valve case 21 is, as shown in FIGS. 2 and 3, composed of: a tube-shaped valve cylinder 22 including a stepped portion where an inlet port 22A as an upstream passage is provided on one side in the axial direction of the casing 2; and a cover 23 where provided on the other side in the axial direction of the valve cylinder 22 and closing the valve cylinder 22 from exterior thereof. Further, within the valve cylinder 22 and at an intermediate portion of the valve cylinder 22 in its axial direction, a valve-body hole 22B is provided in a manner where being in a coaxial relation with the inlet port 22A. The valve-body hole 22B has a hole diameter (or dimension Db1 later explained) which is larger than the one of the inlet port 22A.

In the valve cylinder 22, a circular valve seat 22C is provided at the stepped portion placed between the inlet port 22A and the valve-body hole 22B, wherein the valve body 24 is attached to or detached from the valve seat 22C. Further, the valve cylinder 22 is provided with the discharge port 22D as a downstream passage, on a downstream side of the inlet port 22A and in a manner as to sandwich the valve seat 22C between the inlet port 22A and the valve body 24. The discharge port 22D is extended in a radius direction of the valve-body hole 22B so as to project outward from the valve cylinder 22.

On one side of the valve cylinder 22 in its axial direction, a circular sealing projection 22E is provided so as to surround the inlet port 22A from exterior thereof in its radius direction. As shown in FIG. 2, in a state where the inlet port 22A is fitted (connected) with the exhaust port 16 of the fixed scroll 3, the sealing projection 22E is abutted to the back surface of the fixed scroll 3 (or the end plate 3A) in an airtight manner thereby keeping communication of the back-pressure passage 27 and the intermediate-pressure passage 17.

Here, in the valve cylinder 22, the inlet port 22A, formed into a tubed shape is connected (communicated) with the exhaust port 16 of the fixed scroll 3, and the discharge port 22D is connected with the reservoir 18 via the conduit 19. While the valve body 24, the detail of which will be explained later, is closed, the inlet port 22A is intercepted relative to the discharge port 22*d*, and the exhaust port 16 of the compressor main body 1 (the fixed scroll 3) is to be closed so as to seal compressed air within each of the compression chambers 6.

On the other hand, in a state where the valve body 24 is opened, the inlet port 22A is adapted to communicate with the discharge port 22D, and the exhaust port 16 of the compressor main body 1 (the fixed scroll 3) is to be opened toward the conduit 19. Accordingly, compressed air generated in the compression chamber 6 of the compressor main body 1 is introduced from the exhaust port 16 to the interior of the inlet port 22A of the pressure retaining valve 20, as shown in FIG. 3 (in an arrow A direction), and then to the discharge port 22D in an arrow B direction. The compressed air is finally exhausted toward the reservoir 18 via the conduit 19.

Reference numeral 24 is the valve body where inserted into the valve-body hole 22B of the valve cylinder 22. The valve body 24 is, as shown in FIG. 3, formed into a stepped cylinder where having an external diameter of a dimension Db1, and has one side where provided with an abutting portion 24A that attached to or detached from the valve seat 22C. Further, in the valve body 24, a pressure receiving area where receiving pressure on the inlet port 22A side is set to an inner diameter (dimension Da1) of the abutting portion 24A. This dimension Da1 is formed smaller than the external diameter (dimension Db1) of the valve body 24.

Here, in the valve body 24, a pressure receiving area Sa of the abutting portion 24A on the inlet port 22A side can be determined by the following formula 1, and a pressure receiving area Sb on the back-pressure chamber 26 side later explained can be determined by the following formula 2. The pressure receiving area Sb on the back-pressure chamber 26 side is set to be larger than the pressure receiving area Sa of the abutting portion 24A (i.e., Sb>Sa).

$$Sa=\pi\times Da1^2/4 \quad \text{[Formula 1]}$$

$$Sb=\pi\times Db1^2/4 \quad \text{[Formula 2]}$$

Still further, the valve body 24 is provided with a minor-diameter shaft 24B where positioned on an opposite side of the abutting portion 24A (i.e., on the other side in the axial direction of the valve body 24) and extended toward the interior of the later-explained back-pressure chamber 26. A tip portion of the minor-diameter shaft 24B is, as shown in FIG. 3, abutted to the cover 23 when the valve body 24 is opened, whereby the maximum opening (a lifted amount h) of the valve body 24 can be controlled.

Reference numeral 25 is a back-pressure portion as a back-pressure means partly constituting the pressure retaining valve 20. This back-pressure portion 25 comprises: the back-pressure chamber 26 placed in the valve cylinder 22 and formed between the cover 23 and the valve body 24; and the back-pressure passage 27 formed in the valve cylinder 22 in such a manner where bypassing the valve-body hole 22B in order to communicate the intermediate-pressure passage 17 on the fixed scroll 3 side with the back-pressure chamber 26. Further, the back-pressure passage 27 has one side where communicating with the intermediate-pressure passage 17 via an interior of the circular sealing projection 22E, whereby intermediate pressure from the compressor main body 1 can be introduced into the back-pressure chamber 26.

Reference numeral 28 is the compression spring as an urging member where urging the valve body 24 normally in a direction to be closed. This compression spring 28 is, as shown in FIG. 3, placed within the back-pressure chamber 26, and provided between the cover 23 and the valve body 24 in a preset state. The compression spring 28 is constituted by, for example, a coil spring wound outward in the radius direction of the valve body 24 so as to surround the minor-diameter shaft 24B of the valve body 24.

Here, the compression spring 28 has a spring constant K, and, as shown in FIG. 2, energizes the valve body 24 in a closed state with an urging force F1. Further, as shown in FIG. 3, when the valve body 24 is opened only with the lifted amount h, the compression spring 28 is adapted to energize the valve body 24 in a direction to be closed with an urging force F (determinable when the valve body 24 is in an opened state) according to the following formula 3.

$$F=F1+(K\times h) \quad \text{[Formula 3]}$$

Reference numeral 29 is an O-ring as a sealing member where sealing a portion between the valve cylinder 22 and the valve body 24, and seals the discharge port 22D side of the valve cylinder 22 relative to the back-pressure chamber 26, whereby pressure within the back-pressure chamber 26 can be held as the same pressure with the intermediate-pressure passage 17 side (see FIG. 2).

Next, operation of compressors where the scroll compressor main body 1 according to embodiments of the present invention is applied to will be explained hereinafter.

First, in the compressor main body 1, by making the driving shaft 7A rotated with electricity externally supplied to the electric motor 7, the rotating shaft 8 and the eccentric bushing 11 are driven to rotate at center of the axis of the compressor main body 1. The orbiting scroll 5 then performs orbiting motion with a predetermined turning radius in a state where rotation of the orbiting scroll 5 is restricted by means of, for example, 3 sets of the rotation prevention device 14.

According to the above, each of the compression chambers 6 formed between each of the lap portions 3B of the fixed scroll 3 and each of the lap portions 5B of the orbiting scroll 5 is successively compressed from the external diameter side (i.e., the compression chamber 6 farthest relative to the exhaust port 16 in a radius direction) to the inner diameter side (i.e., the compression chamber 6 nearest relative to the exhaust port 16 in a radius direction). Among these compression chambers, the compression chamber 6 placed on the external diameter side will inhale air as fluid via the inhale port 15 provided on the outer periphery side of the fixed scroll 3 so as to successively compress the inhaled air within each of the compression chambers 6. The compressed air is then exhausted from the compression chamber 6 on the inner diameter side to the inlet port 22A of the pressure retaining valve 20 (the valve cylinder 22) via exhaust port 16.

Here, the valve body 24 of the pressure retaining valve 20 is energized by means of the compression spring 28 with the urging force F1. On the other hand, within the back-pressure chamber 26, back pressure from the intermediate-pressure passage 17 is introduced as an intermediate pressure Pb. So, the valve body 24 receives an exhaust pressure Pa of the compressed air exhausted from the exhaust port 16 of the compressor main body 1 with a pressure receiving area Sa based on the aforementioned formula 1. The valve body 24 also receives the intermediate pressure Pb generated from the back-pressure chamber 26 with a pressure receiving area Sb based on the aforementioned formula 2.

With this structural feature, the valve body 24 of the pressure retaining valve 20 are affected by: force pressurizing the valve body 24 in a direction to be opened (Pa×Sa) and force pressurizing the valve body 24 in a direction to be closed (F1+Pb×Sb). That is, the valve body 24 is to be opened or closed based on intensity of the forces (large or small), or more specifically, based on value variation of the exhaust pressure Pa and the intermediate pressure Pb.

Here, the exhaust pressure Pa, intermediate pressure Pb and internal pressure Pt of the reservoir 18 can be expressed in conditions (1) to (4) of below table 1. The conditions are categorized by, when the compressor main body 1 is: started; in steady motion; stopped; and in standstill state.

TABLE 1

| | Working Condition | Exhaust Pressure Pa | Intermediate Pressure Pb | Internal Pressure Pt |
|---|---|---|---|---|
| Condition (1) | Started | Pas | Pb1 | 0 |
| Condition (2) | In Steady Motion | Po | Pb2 | Po |
| Condition (3) | Stopped | Po | Pb3 | Po |
| Condition (4) | In Standstill state | 0 | 0 | Po |

To be more specific, when the compressor main body 1 is "Started" (Condition (1)), the internal pressure Pt of the reservoir 18 becomes the minimum pressure (Pt=0) equivalent with ambient pressure, and supposing the exhaust pressure Pa of the compressed air when started is set to Pa=Pas, the intermediate pressure Pb within the back-pressure chamber 26 becomes Pb=Pb1 (but needs to satisfy Pb1<Pas).

As discussed, when the compressor main body 1 is started, the valve body 24 of the pressure retaining valve 20 will be kept in a closed state until satisfying a formula 4 below, whereby the compressed air from the exhaust port 16 is prevented from being exhausted to the discharge port 22D of the valve cylinder 22, the conduit 19, and the reservoir 18.

$$(Pas \times Sa) = (F1 + Pb1 \times Sb) \quad \text{[Formula 4]}$$

Next, when the exhaust pressure Pa of the compressed air is raised more than a pressure Pas along with the start of the compressor main body 1, the valve body 24 of the pressure retaining valve 20 is to be opened as shown in FIG. 3. Accordingly, the compressed air from the exhaust port 16 is to be exhausted to the inlet port 22A of the pressure retaining valve 20, the discharge port 22D, and the reservoir 18 via the conduit 19 as shown in FIG. 2.

When the compressor main body 1 is reached to "In Steady Motion" (i.e., operated in steady state) in Condition (2), this means the condition where the internal pressure Pt is raised up to a predetermined setting pressure Po (rated pressure). In this state, the exhaust pressure Pa of the compressed air is raised up to the setting pressure Po originally determined (but needs to satisfy Pa=Po), and the intermediate pressure Pb within the back-pressure chamber 26 is set to a pressure satisfying Pb=Pb2 (but needs to satisfy Pb1<Pb2<Po).

Furthermore, in this steady state, the valve body 24 of the pressure retaining valve 20 is opened with the lifted amount h as shown in FIG. 3. Here, the valve body 24 receives pressing force (Po×Sa) working in a direction to be opened, and concurrently the valve body 24 is affected by pressing force (K×h+F1+Pb2×Sb) working in a direction to be closed, the pressing force of which is generated by the urging force F of the compression spring 28 according to the formula 3 and the intermediate pressure Pb2.

Therefore, when the compressor main body 1 is "In Steady Motion," by satisfying an inequality formula 5 below, the valve body 24 of the pressure retaining valve 20 can be held to be fully opened with the lifted amount h.

$$(Po \times Sa) > (k \times h) + F1 + (Pb2 \times Sb) \quad \text{[Formula 5]}$$

On the other hand, when the compressor main body 1 is "Stopped" (i.e., the time operation is shut down) in Condition (3), the internal pressure Pt is kept to be the setting pressure Po. In this state, the exhaust pressure Pa of the compressed air is also kept to be the setting pressure Po (but needs to satisfy Pa=Po), and the intermediate pressure Pb within the back-pressure chamber 26 will satisfy Pb=Pb3 (but also needs to satisfy Pb2<Pb3≈Po). When the compressor main body 1 is stopped, the intermediate pressure Pb3 will be provisionally raised up to value approximately the setting pressure Po. Here, in order to achieve immediate close of the valve body 24 of the pressure retaining valve 20 along with stoppage of the compressor main body 1, the following inequality formula 6 needs to be satisfied.

$$(Po \times Sa) < (K \times h) + F1 + (Pb3 \times Sb) \quad \text{[Formula 6]}$$

Moreover, while the compressor main body 1 is "In Standstill State" in Condition (4), the internal pressure Pt is kept to be the setting pressure Po; however, since the compressed air has not been exhausted up to this time, the exhaust pressure Pa becomes the minimum pressure (Pa=0) being equal to atmospheric pressure, and the intermediate pressure Pb is also lowered up to the minimum pressure (Pb=0). Here, in order to keep the valve body 24 of the pressure retaining valve 20 to be closed while the compressor main body 1 is "In Standstill State," the following inequality formula 7 needs to be satisfied.

$$Po \times (Sb - Sa) < F1 \quad \text{[Formula 7]}$$

In this case, the left-hand side of the formula 7 shows force pressing the valve body 24 in a direction to be opened while the compressor main body 1 is "In Standstill State," and the internal pressure Pt (Po) from the reservoir 18 will affect the valve body 24 only by difference between the pressure receiving area Sa and Sb (i.e., Sb−Sa) according to the aforementioned formula 1 and 2.

Thus, if the pressure receiving area Sa, Sb of the valve body 24 (i.e., dimensions Da1 and Db1 in FIG. 3), a spring-constant K of the compression spring 28, and the urging force F1 are selected as designing particulars in order to satisfy the aforementioned formulas 4 to 7, it is possible not only to close the valve body 24 of the pressure retaining valve 20 when the compressor main body 1 is started or stopped, but also to keep the valve body 24 closed while the compressor main body 1 is in standstill state. Further, when the compressor main body 1 is in steady motion, the valve body 24 can be kept fully opened with the lifted amount h.

Here, according to the present embodiments, the pressure retaining valve 20 which retains the exhaust pressure Pa is provided on the exhaust port 16 side of the compressor main body 1, and the valve body 24 of the pressure retaining valve 20 is fabricated as that it opens when the exhaust pressure Pa of compressed air goes beyond both the intermediate pressure Pb (back pressure) within the back-pressure chamber 26 and the urging force F1 of the compression spring 28.

Accordingly, at an initial stage where driving the scroll compressor main body 1, until the exhaust pressure Pa is raised more than the pressure Pas shown in Table 1, the valve body 24 is closed by means of force (F1+Pb1×Sb) where working in a direction to be closed, which is indicated in the right-hand portion of the formula 4. The compressor main body 1 can thus display pressure-retaining functions where holding pressure on the exhaust port 16 side of the compressor main body 1.

To be more specific, by keeping the pressure retaining valve 20 closed at the initial stage driving the compressor main body 1, it is possible to seal compressed air within the compressed chamber 6 placed between the fixed scroll 3 and the orbiting scroll 5, whereby air pressure of this time will affect on the end plate 5A of the orbiting scroll 5 as thrust load. Further, the thrust load of this time will be received on the first/second thrust points 14A, 14B and the ball 14C of the rotation prevention device 14, whereby it can prevent the orbiting scroll 5 from being deviated in the axial direction of the casing 2 or from being aslant relative to the fixed scroll 3, contributing to stable orbiting motion of the orbiting scroll 5.

Especially, as regards the fixed scroll 3 and the orbiting scroll 5 applied to the compressor main body 1, consideration for thermal expansion due to compressional heat is given to each of the lap portions 3B and 5B. Specifically, clearance in the axial direction is provided beforehand relative to the surface of the end plate 5A and 3A. Here, for example, in a state prior to start of compression performance where the lap portions 3B and 5B are not affected by the thermal expansion, the orbiting scroll 5 may be jounced or vibrated only for the clearance in the axial direction, thus increasing frequencies of unstable performance occurrences.

Further, in case that the rotation prevention device 14 of the orbiting scroll 5 is constituted with the ball-coupling mechanism, since the spherical ball 14C is caught only by two of the thrust points 14A, 14B, the orbiting scroll 5 may be easily displaced only for the clearance in the axial direction when, for example, the compression performance is started, thus increasing frequencies of unstable occurrences.

Considering the above negative effects, in the present invention, when the compressor main body 1 is started, the pressure retaining valve 20 is kept closed, whereby compressed air is sealed within the compression chamber 6 placed between the fixed scroll 3 and the orbiting scroll 5. Here, Air pressure of this moment affects the end plate 5A of the orbiting scroll 5, as thrust load.

Consequently, when the compressor main body 1 is started, even in a state prior to start of compression performance where the lap portions 3B, 5B are not affected by the thermal expansion, it is possible to control the orbiting scroll 5 not to be jounced or vibrated only for the clearance in the axial direction by means of pressure of the compressed air sealed within the compression chamber 6, contributing to suppression of unstable performance of the orbiting scroll 5.

Still further, subsequent to start of the compressor main body 1, when the exhaust pressure Pa of the compressed air generated on the side of the exhaust port 16 is raised more than the pressure Pas shown in Table 1, the valve body 24 can be opened against the force (F1+Pb1×Sb) in a direction to be closed, i.e., the force on the right-hand side of the aforementioned formula 4. The compressed air generated from the exhaust port 16 can be then exhausted from the discharge port 22D of the pressure retaining valve 20 to the reservoir 18 placed exteriorly via the conduit 19.

When the compressor main body 1 is in steady motion, the valve body 24 of the pressure retaining valve 20 can be kept fully opened with the normal lifted amount h. Accordingly, it is possible to minimize occurrence of pressure loss (depletion) due to the pressure retaining valve 20 between the exhaust port 16 of the compressor main body 1 and the conduit 19, whereby effectiveness of the compressor main body 1 as compressors can be well advanced.

Moreover, in the steady motion of the compressor main body 1, pressure of air where compressed within each of the compression chambers 6 will affect the end plate 5A of the orbiting scroll 5, as thrust load. However, between the pedestal portion 2D of the casing 2 and the back surface side of the orbiting scroll 5 (installing portion 5D), 3 pairs of the rotation prevention devices 14 (ball-coupling mechanism) each composed of the first thrust point 14A, the second thrust point 14B and the ball 14C are provided.

With this structure, thrust load applied to the end plate 5A of the orbiting scroll 5 can be received between the first/second thrust points 14A, 14B and the ball 14C of the rotation prevention device 14, whereby it is possible to prevent the orbiting scroll 5 from being displaced in the axial direction of the casing 2 or being aslant relative to the fixed scroll 3, contributing to stable orbiting motion of the orbiting scroll 5.

On the other hand, when the compressor main body 1 is stopped, the valve body 24 of the pressure retaining valve 20 can be immediately closed. Accordingly, it is possible with the pressure retaining valve 20 to prevent the compressed air within the reservoir 18 from reflowing toward the exhaust port 16 side subsequent to stop of the compressor main body 1. With this, for example, a back-stop prevention for the orbiting scroll 5 can be easily achieved.

In addition, when the compressor main body 1 is in standstill state, by keeping the valve body 24 of the pressure retaining valve 20 closed, as shown in Condition (4) of Table 1, the internal pressure Pt of the reservoir 18 can be kept to the setting pressure Po as an original rated pressure, contributing to good prevention of pressure leakage due to the pressure retaining valve 20.

Still further, the pressure retaining valve 20 may be fabricated into a simple structure such as a single valve device composed of, for example, the valve case 21, the valve body 24, the back-pressure chamber 26, the compression spring 28, etc. The pressure retaining valve 20 fabricated in this manner can be easily installed by fitting thereof on the exhaust port 16 side of the fixed scroll 3. Moreover, it is possible to reduce a total number of members thereby, for example, enabling to eliminate exclusive check valves preventing pressure within the reservoir 18, etc. from being reflowed.

According to the present embodiments, by applying the pressure retaining valve 20 as the single valve device hereinbefore discussed, the structure of compressors including the scroll compressor main body 1 can be simplified. Further, not only do the compressors achieve miniaturization and weight-saving, but durability, life-time, reliability, etc. of the compressors can be concurrently improved by making performance of the orbiting scroll 5 stabilized, for example, at start of the compressors.

Moreover, in the present embodiments, the pressure receiving area Sb on the side of the back-pressure chamber 26 has larger area than the pressure receiving area Sa on the abutting portion 24A side of the valve body 24 (Sb>Sa). Accordingly, even though the intermediate pressure Pb within the back-pressure chamber 26 is set to considerably low pressure compared to the exhaust pressure Pa of compressed air, the valve body 24 can be opened and closed in a stable manner.

In addition, considering the intermediate-pressure passage 17 communicated with the back-pressure passage 27, among each of the compression chambers 6 of the compressor main body 1 (or, between the fixed scroll 3 and the orbiting scroll 5), the intermediate pressure Pb can be extracted from the compression chamber 6 with relatively low pressure (i.e., the compression chamber 6 placed on the external diameter side than the inner diameter side of the compressor main body 1). With this, when the compressor main body 1 is started, stopped or in standstill state, the valve body 24 of the pressure retaining valve 20 can be kept in a closed state thereby displaying pressure retaining functions.

Figure 4:
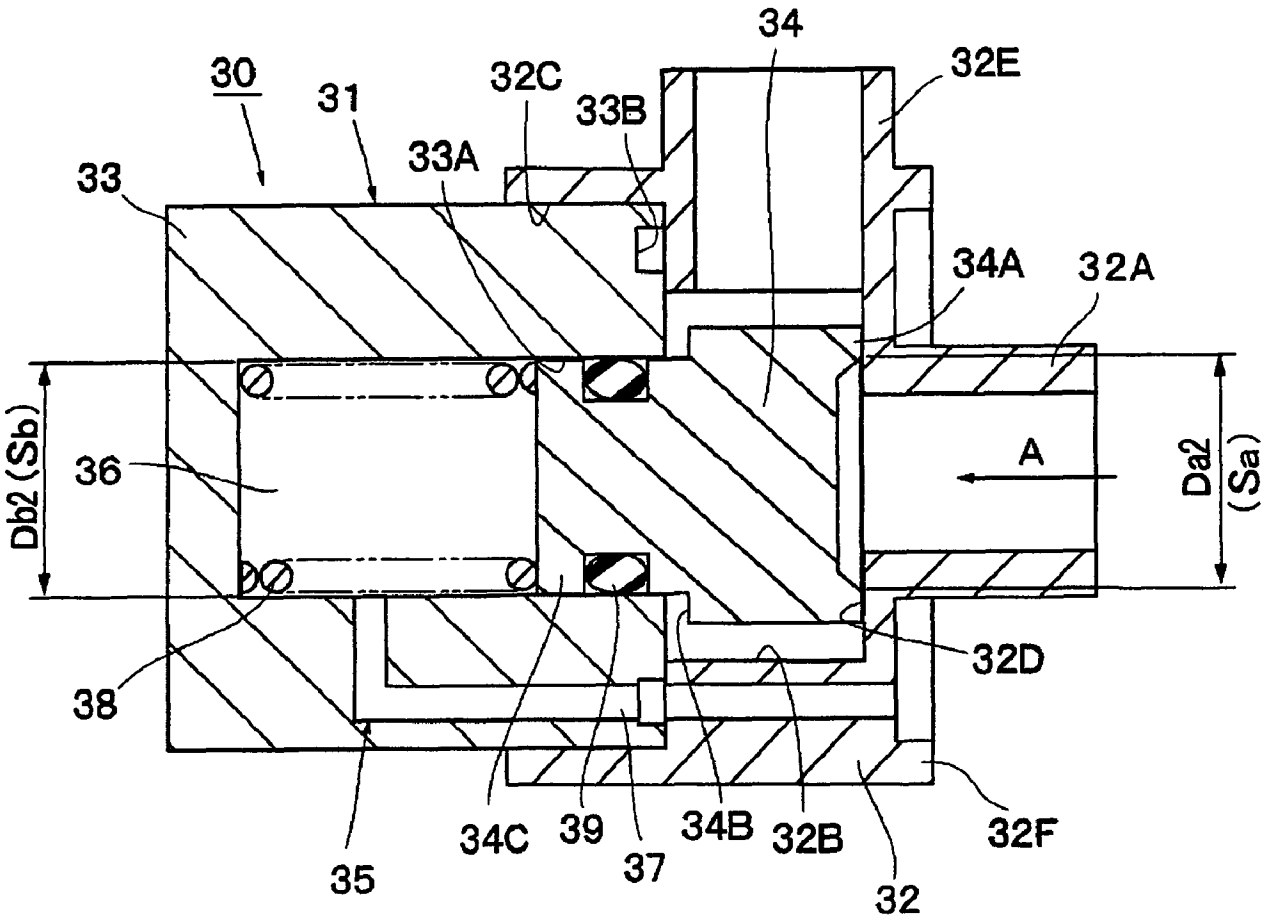
FIG. 4 is a cross-sectional view showing a pressure retaining valve according to a second embodiment of the present invention.
Figure 5:
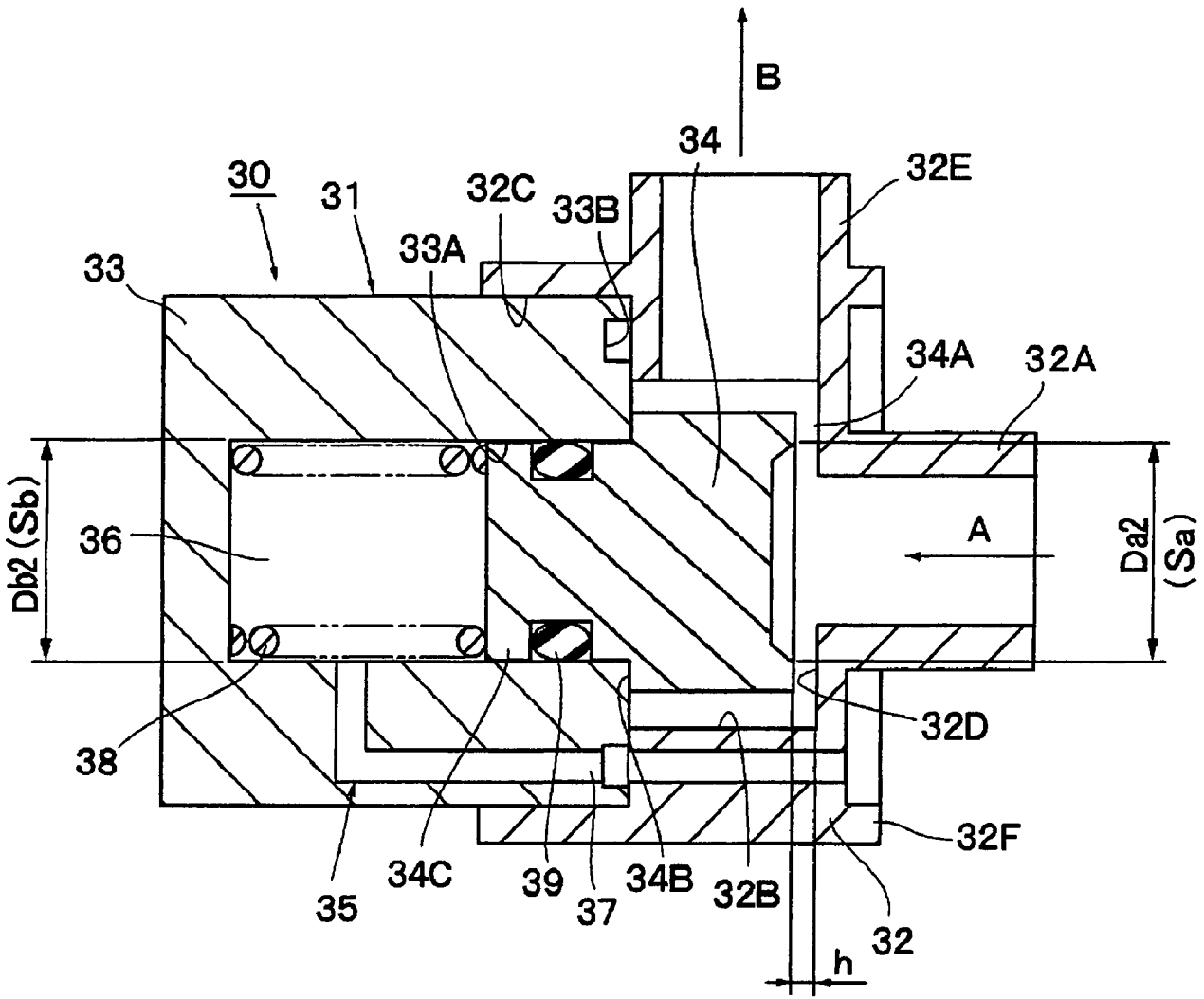
FIG. 5 is a cross-sectional view showing a state where the pressure retaining valve in FIG. 4 is opened.

Next, FIGS. 4 and 5 show a second embodiment of the present invention. In the second embodiment, a pressure receiving area of a valve body in a pressure retaining device is arranged as that the pressure receiving area of a compression fluid side is substantially identical with the pressure receiving area of a back-pressure side. Any components identical with or corresponding to those of the aforementioned first embodiment are denoted by the same reference numerals, and a detailed description thereof will be omitted below.

In FIGS., reference numeral 30 indicates a pressure retaining valve as a pressure retaining device applied in the present embodiments, and the pressure retaining valve 30 is, as the same with the pressure retaining valve 20 described in the first embodiment, provided on an exhaust side of the compressor main body 1, and comprises: a valve case 31; a valve body 34; a back-pressure chamber 36; a compression spring 38, etc., the details of which are explained hereinafter. As regards the pressure retaining valve 30, by opening and closing the valve body 34 later explained, the exhaust port 16 of the compressor main body 1 (the fixed scroll 3) is communicated with or intercepted from the reservoir 18.

Reference numeral 31 indicates the valve case, which constitutes an outer shell of the pressure retaining valve 30. The valve case 31 is, as shown in FIGS. 4 and 5, composed of: a tube-shaped valve cylinder 32 including a stepped portion where an inlet port 32A as an upstream passage is provided on one side in the axial direction of the casing 2; and a closed-end retention cylinder 33, formed into a tube-shape, provided at the valve cylinder 32 so as to close the other side of the valve cylinder 32 in the axial direction of the casing 2.

Further, an inner periphery of the retention cylinder 33 is formed into a valve-body hole 33A into which the later-explained valve body 34 is inserted. The valve-body hole 33A is formed to be in a coaxial relation with the inlet port 32A of the valve cylinder 32. Still further, an opening end of the retention cylinder 33 (one side end in the axial direction of the casing 2) is provided with an annular groove 33B extending all-around of the retention cylinder 33. The annular groove 33B partly constitutes a back-pressure passage 37, the detail of which will be explained hereinafter.

On the other hand, an inner periphery of the valve cylinder 32 is provided with: a valve holding hole 32B having a diameter larger than the one of the valve body 34; and a fitting hole 32C where provided on the other side of the valve holding hole 32B in the axial direction of the casing 2 and having a diameter larger than the one of the valve holding hole 32B. The fitting hole 32C has an opening into which one side of the retention cylinder 33 is fitted.

Still further, the valve cylinder 32 is provided with a circular valve seat 32D at a stepped portion between the inlet port 32A and the valve holding hole 32B, wherein the later-explained valve body 34 is attached to or detached from the valve seat 32D. Moreover, the valve cylinder 32 is provided with a discharge port 32E as a downstream passage, on a downstream side of the inlet port 32A and so as to sandwich the valve seat 32D between the inlet port 32A and the valve body 34. The discharge port 32E is extended in a radius direction of the valve holding hole 32B so as to project outward from the valve cylinder 32.

On one side of the valve cylinder 32 in the axial direction of the casing 2, a circular sealing projection 32F is provided so as to surround the inlet port 32A from exterior thereof in its radius direction. As the same with the sealing projection 22E explained in the first embodiment, in a state where the inlet port 22A is fitted (connected) with the exhaust port 16 of the fixed scroll 3 as shown in FIG. 2, the sealing projection 32F is abutted to the back surface of the fixed scroll in an airtight manner thereby keeping communication of the back-pressure passage 37 and the intermediate-pressure passage 17.

Here, in the valve cylinder 32, as the same with the valve cylinder 22 explained in the first embodiment, the tube-shaped inlet port 32A is connected (communicated) with the exhaust port 16 of the fixed scroll 3, and the discharge port 32E is connected with the reservoir 18 via the conduit 19. When the valve body 34 is then opened, compressed air from the compressed main body 1 is adapted to inflow into the inlet port 32A (in arrow A direction in FIG. 5) and to exhaust toward the discharge port 32E (in arrow B direction in the same figure).

Reference numeral 34 is the valve body where slidably inserted into the valve holding hole 32B of the valve cylinder 32 and extended into the retention cylinder 33. The valve body 34 is formed into a cylindrical shape with a stepped portion, one side (the fixed scroll 3 side) of which is provided with an abutting portion 34A that attached to or detached from the valve seat 32D. Further, in the valve body 34, a pressure receiving area where receiving pressure on the inlet port 32A side is set to an inner diameter (dimension Da2) of the abutting portion 34A.

Further, in the valve body 34, on the other side (the back-pressure chamber 36 side relative to the abutting portion 34A) in its axial direction, a small diameter portion 34C, the diameter of which is reduced at an annular stepped portion 34B, is provided. The small diameter portion 34C has, as shown in FIGS. 4 and 5, an external diameter of dimension Db2 and is inserted into the valve-body hole 33A of the retention cylinder 33. Moreover, the external diameter of the small diameter portion 34C (dimension Db2) is set to be identical with an inner diameter of the abutting portion 34A (dimension Da2).

Here, in the valve body 34, a pressure receiving area Sa of the abutting portion 34A on the inlet port 32A side can be determined by the following formula 8, and a pressure receiving area Sb on the later-explained back-pressure chamber 36 can be calculated by the following formula 9. The pressure receiving area Sb on the back-pressure chamber 36 side is set to have substantially the same area with the pressure receiving area Sa of the abutting portion 34A.

$$Sa=\pi\times Da2^2/4 \quad \text{[Formula 8]}$$

$$Sb=\pi\times Db2^2/4 \quad \text{[Formula 9]}$$

Further, in the valve body 34, as shown in FIG. 5, when the abutting portion 34A is opened by detaching from the valve seat 32D, the annular stepped portion 34B is abutted to an opening end (one side end in the axial direction) of the retention cylinder 33. With this, the annular stepped portion 34B will control the maximum opening of the valve body 34 up to the lifted amount h.

Reference numeral 35 is a back-pressure portion as a back-pressure means, wherein the back-pressure portion 35 comprises: the back-pressure chamber 36 placed between the retention cylinder 33 of the valve case 31 and the small diameter portion 34C of the valve body 34; the valve holding hole 32B connecting the intermediate-pressure passage 17 on the fixed scroll 3 side (see FIG. 2) with the back-pressure chamber 36; and the back-pressure passage 37 fabricated at the valve cylinder 32 extended through the retention cylinder 33 so as to bypass the valve-body hole 33A. Further, the back-pressure passage 37, as the same with the back-pressure passage 27 discussed in the first embodiment, is to introduce intermediate pressure from the compressor main body 1 into the back-pressure chamber 36.

Reference numeral 38 is the compression spring as an urging means normally urging the valve body 34 in a direction to be closed. The compression spring 38 is, as shown in FIG. 4, placed within the back-pressure chamber 36, and between the retention cylinder 33 and the small diameter portion 34C of the valve body 34 in a preset state. Moreover, the compression spring 38 is set in a manner that a spring constant K and an urging force F1 satisfy relations of the formulas 4 to 6 hereinbefore discussed.

Reference numeral 39 is an O-ring as a sealing member where sealing a portion between the retention cylinder 33 and the small diameter portion 34C of the valve body 34, and seals the discharge port 32E side of the valve cylinder 32 relative to the back-pressure chamber 36, whereby pressure within the back-pressure chamber 36 can be held as the same pressure with the intermediate-pressure passage 17 side (see FIG. 2).

Accordingly, also in the second embodiment of the present invention, when the compressor main body 1 is started, it is possible to close the valve body 34 of the pressure retaining valve 30 and to open or close the valve body 34 according as the exhaust pressure Pa of the inlet port 32A side (the exhaust port 16) and the intermediate pressure Pb of the back-pressure chamber 36 side. Therefore, almost identical functional effects with the first embodiment can be obtained.

Still further, in the second embodiment, the valve body 34 is fabricated in such a manner that the pressure receiving area Sa of the abutting portion 34A on the inlet port 32A side is equal to the pressure receiving area Sb on the back-pressure chamber 36 side (i.e., Sb=Sa). Therefore, after the compressor main body 1 is stopped, difference between the pressure receiving areas Sa and Sb (i.e., Sb−Sa) where shown at the left-hand side of the above-mentioned formula 7 becomes null (zero), whereby the valve body 24 can be kept in a closed state by means of the urging force F1 of the compression spring 38.

Next, a third embodiment of the present invention will be hereinafter explained with reference to FIG. 6. In the third embodiment, a pressure receiving area of a valve body in a pressure retaining device is arranged as that the pressure receiving area of a compression fluid side is set to be larger than the pressure receiving area of a back-pressure side. Any components identical with or corresponding to those of the aforementioned first embodiment are denoted by the same reference numerals, and a detailed description thereof will be omitted below.

Figure 6:
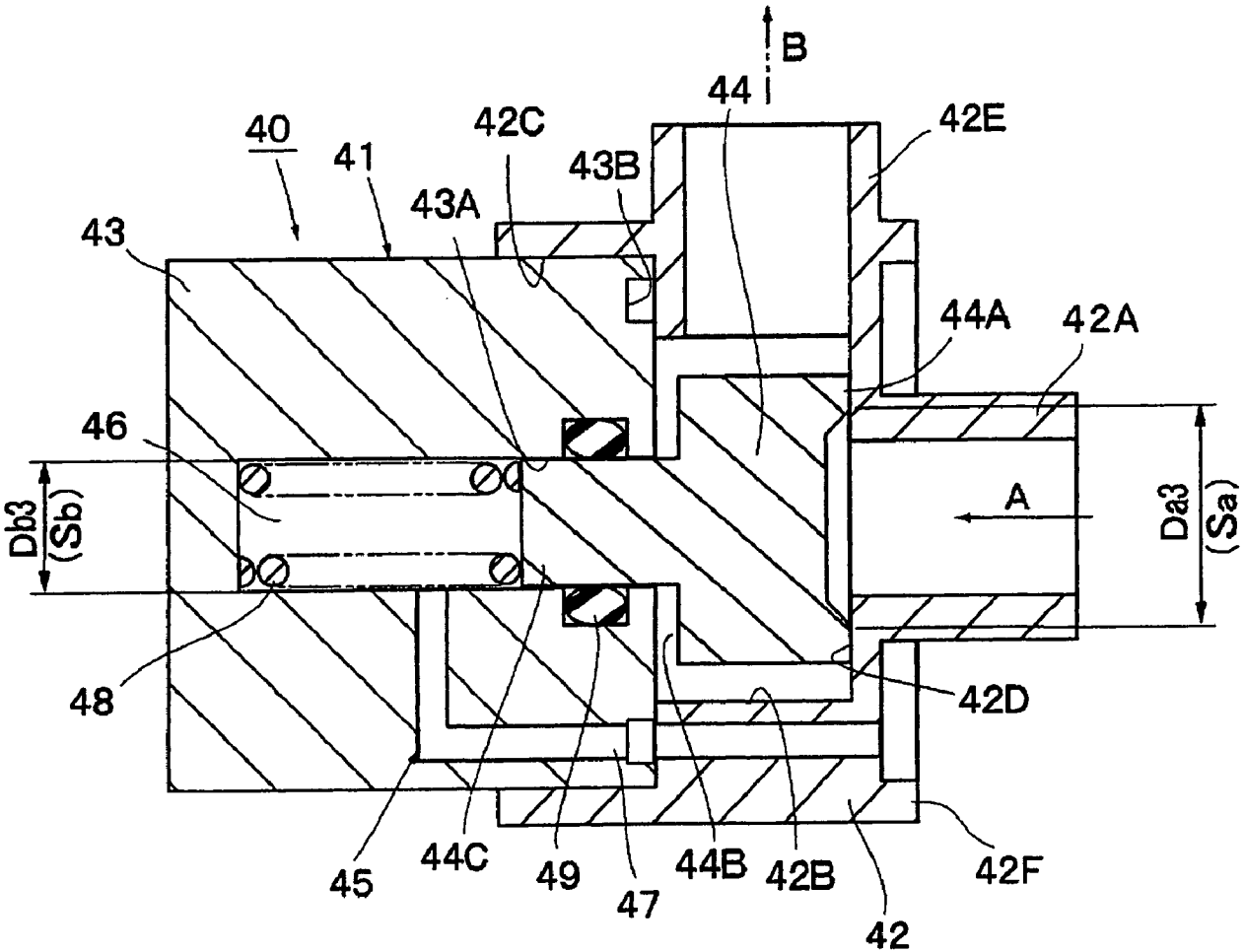
FIG. 6 is a cross-sectional view showing a pressure retaining valve according to a third embodiment of the present invention.

In FIG. 6, reference numeral 40 is a pressure retaining valve as a pressure retaining device applied in the present embodiment. The pressure retaining valve 40 is, as the same with the pressure retaining valve 20 explained in the first embodiment, provided on an exhaust side of the compressor main body 1, and comprises: a valve case 41; a valve body 44; a back-pressure chamber 46; and a compression spring 48, etc. Further, in the pressure retaining valve 40, by opening and closing the later-explained valve body 44, the exhaust port 16 of the compressor main body 1 (the fixed scroll 3) can be communicated or intercepted relative to the reservoir 18.

Reference numeral 41 is the valve case, which constitutes an outer shell of the pressure retaining valve 40. The valve case 41, as approximately the same with the valve case 31 as discussed in the second embodiment, comprises: a tube-shaped valve cylinder 42 with a stepped portion; and a tube-shaped retention cylinder 43 with a closed-end. Further, the valve cylinder 42, constituted as the same with the valve cylinder 32 as discussed in the second embodiment, includes: an inlet port 42A; a valve holding hole 42B; a fitting hole 42C; a circular valve seat 42D; a discharge port 42E; and a sealing projection 42F.

In the valve case 41 of this case, however, a valve-body hole 43A of the retention cylinder 43 is formed into a small dimension Db3 identical with a small diameter portion 44C of the valve body 44, which is different from the second embodiment. Further, an opening end of the retention cylinder 43 (one side end in the axial direction) is provided with an annular groove 43B extending all-around of the retention cylinder 43. The annular groove 43B partly constitutes a back-pressure passage 47, the detail of which will be explained hereinafter.

Reference 44 is the valve body slidably inserted into the valve holding hole 42B of the valve cylinder 42 and extended to the retention cylinder 43. The valve body 44, constituted as approximately the same with the valve body 34 as discussed in the second embodiment, comprises: an abutting portion 44A; an annular stepped portion 44B; and the small diameter portion 44C, etc. Further, in the valve body 44, a pressure receiving area where receiving pressure on the inlet port 42A side is controlled by an inner diameter (dimension Da3) of the abutting portion 44A.

However, in the small diameter portion 44C of the valve body 44, the outer diameter thereof is formed into a small diameter of the dimension Db3, so that the small diameter portion 44C is inserted into the valve-body hole 43A of the retention cylinder 43. The outer diameter of the small diameter portion 44C (dimension Db3) is formed to have a dimension smaller than the inner diameter of the abutting portion 44A (dimension Da3).

Here, in the valve body 44, a pressure receiving area Sa of the abutting portion 44A on the inlet port 42A side can be determined by the following formula 10, and a pressure receiving area Sb on the later-explained back-pressure chamber 46 side can be calculated by the following formula 11. Here, the pressure receiving area Sb on the back-pressure chamber 46 side is set smaller than the pressure receiving area Sa of the abutting portion 44A (Sb<Sa).

$$Sa=\pi\times Da3^2/4 \quad \text{[Formula 10]}$$

$$Sb=\pi\times Db3^2/4 \quad \text{[Formula 11]}$$

Reference numeral 45 is a back-pressure portion as a back-pressure means, wherein the back-pressure portion 45 comprises: the back-pressure chamber 46 placed between the retention cylinder 43 of the valve case 41 and the small diameter portion 44C of the valve body 44; the valve holding hole 42B connecting the intermediate-pressure passage 17 on the fixed scroll 3 side (see FIG. 2) with the back-pressure chamber 46; and the back-pressure passage 47 fabricated at the valve cylinder 42 extended through the retention cylinder 43 so as to bypass the valve-body hole 43A. Further, the back-pressure passage 47, as the same with the back-pressure passage 27 discussed in the first embodiment, is to introduce intermediate pressure from the compressor main body 1 into the back-pressure chamber 46.

Reference numeral 48 is the compression spring as an urging means normally urging the valve body 44 in a direction to be closed. The compression spring 48 is placed within the back-pressure chamber 46, and between the retention cylinder 43 and the small diameter portion 44C of the valve body 44 in a preset state. Moreover, the compression spring 48 is set in a manner that a spring constant K and an urging force F1 satisfy relations of the formulas 4 to 6 hereinbefore discussed.

Reference numeral 49 is an O-ring as a sealing member where sealing a portion between the retention cylinder 43 and the small diameter portion 44C of the valve body 44, and seals the discharge port 42E side of the valve cylinder 42 relative to the back-pressure chamber 46, whereby pressure within the back-pressure chamber 46 can be held as the same pressure with the intermediate-pressure passage 17 side (see FIG. 2).

Accordingly, also in the third embodiment of the present invention, when the compressor main body 1 is started, it is possible to close the valve body 44 of the pressure retaining valve 40 and to open or close the valve body 44 according as the exhaust pressure Pa of the inlet port 42A side (the exhaust port 16) and the intermediate pressure Pb of the back-pressure chamber 46 side. Therefore, almost identical functional effects with the first embodiment can be obtained.

Furthermore, in the valve body 44 based on this embodiment, the pressure receiving area Sa of the abutting portion 44A on the inlet port 42A side is set to be larger than the pressure receiving area Sb on the back-pressure chamber 46 side (Sb<Sa). Still further, when the valve body 44 is closed, internal pressure Pt (Po) from the reservoir 18 is made to affect the stepped portion 44B of the valve body 44 as force working in a direction to be closed, whereby the internal pressure Pt together with the compression spring 48 (urging force F1) can keep the valve body 44 in a closed state.

Figure 7:
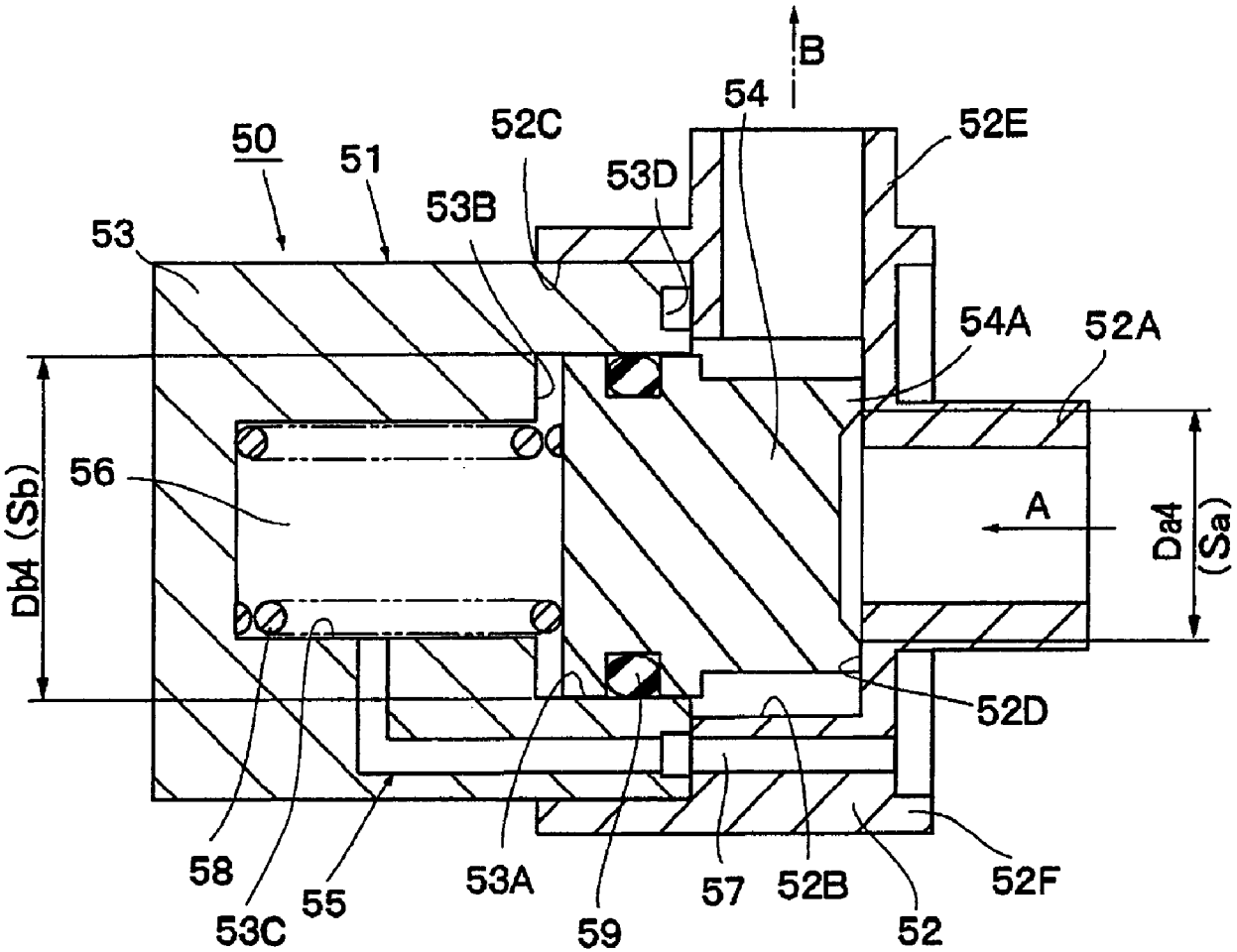
FIG. 7 is a cross-sectional view showing a pressure retaining valve according to a fourth embodiment of the present invention.

Next, FIG. 7 shows a fourth embodiment of the present invention, the features of which are explained as follows. In a pressure receiving area of a valve body in a pressure retaining device, the pressure receiving area on a back-pressure side is set to be larger than the area on a compression fluid side. Here, any components identical with or corresponding to those of the aforementioned first embodiment are denoted by the same reference numerals, and a detailed description thereof will be omitted below.

In FIG. 7, reference numeral 50 is a pressure retaining valve as a pressure retaining device applied in the present embodiment. The pressure retaining valve 50 is, as the same with the pressure retaining valve 20 explained in the first embodiment, provided on an exhaust side of the compressor main body 1, and comprises: a valve case 51; a valve body 54; a back-pressure chamber 56; and a compression spring 58, etc. Further, in the pressure retaining valve 50, by opening and closing the later-explained valve body 54, the exhaust port 16 of the compressor main body 1 (the fixed scroll 3) can be communicated or intercepted relative to the reservoir 18.

Reference numeral 51 is the valve case, which constitutes an outer shell of the pressure retaining valve 50. The valve case 51, as approximately the same with the valve case 31 as discussed in the second embodiment, comprises: a tube-shaped valve cylinder 52 with a stepped portion; and a tube-shaped retention cylinder 53 with a closed-end. Further, the valve cylinder 52, constituted as the same with the valve cylinder 32 as discussed in the second embodiment, includes: an inlet port 52A; a valve holding hole 52B; a fitting hole 52C; a circular valve seat 52D; a discharge port 52E; and a sealing projection 52F.

Compared with the second embodiment, the retention cylinder 53 of the valve case 52 has an inner periphery where not only a large-diameter valve-body hole 53A but also a circular stepped portion 53B and a small-diameter closed-end groove 53C are provided, which are different from the second embodiment. Further, the valve-body hole 53A in this case is placed on an opening end side of the retention cylinder 53, and formed to have a hole diameter of a dimension Db4 which corresponds with an outer diameter of the valve body 54 later explained. Still further, an opening end of the retention cylinder 53 (one side end in the axial direction) is provided with an annular groove 53D extending all-around of the retention cylinder 53. The annular groove 53D partly constitutes a back-pressure passage 57, the detail of which will be explained hereinafter.

Reference numeral 54 is the valve body where slidably inserted into the valve holding hole 52B of the valve cylinder 52 and extended into the retention cylinder 53. The valve body 54 is inserted into the valve-body hole 53A of the retention cylinder 53, and is provided with an abutting portion 54A on one side thereof in its axial direction (the fixed scroll 3 side) where the abutting portion 54A is attached to or detached from the valve seat 52D. Further, when the valve body 54 is opened, the other side thereof in its axial direction (back-pressure side) is adapted to abut to the stepped portion 53B of the retention cylinder 53, whereby the maximum opening of the valve body 54 can be controlled.

Here, in the valve body 54, a pressure receiving area where receiving pressure on the inlet port 52A side is defined by an inner diameter of the abutting portion 54A (dimension Da4). This dimension Da4 is formed so as to be smaller than an outer diameter of the valve body 54 (dimension Db4). In the valve body 54, a pressure receiving area Sa of the abutting portion 54A on the inlet port 52A side can be defined by the following formula 12, and a pressure receiving area Sb on the later-explained back-chamber 56 side can be calculated by the following formula 13. In addition, the pressure receiving area Sb on the back-pressure chamber 56 side is set to be larger than the pressure receiving area Sa of the abutting portion 54A (i.e., Sb>Sa).

$$Sa=\pi\times Da4^2/4 \quad \text{[Formula 12]}$$

$$Sb=\pi\times Db4^2/4 \quad \text{[Formula 13]}$$

Reference numeral 55 is a back-pressure portion as a back-pressure means, wherein the back-pressure portion 55 comprises: the back-pressure chamber 56 placed between the retention cylinder 53 of the valve case 51 and the valve body 54; the valve holding hole 52B connecting the intermediate-pressure passage 17 on the fixed scroll 3 side (see FIG. 2) with the back-pressure chamber 56; and the back-pressure passage 57 fabricated at the valve cylinder 52 extended through the retention cylinder 53 so as to bypass the valve-body hole 53A and the closed-end groove 53C. Further, the back-pressure passage 57, as the same with the back-pressure passage 27 discussed in the first embodiment, is to introduce intermediate pressure from the compressor main body 1 into the back-pressure chamber 56.

Reference numeral 58 is the compression spring as an urging means normally urging the valve body 54 in a direction to be closed. The compression spring 58 is placed within the back-pressure chamber 56, and between the closed-end groove 53C of the retention cylinder 53 and an end of the valve body 54 in a preset state. Moreover, the compression spring 58 is set in a manner that a spring constant K and an urging force F1 satisfy relations of the formulas 4 to 6 hereinbefore discussed.

Reference numeral 59 is an O-ring as a sealing member where sealing a portion between the retention cylinder 53 and the valve body 54, and seals the discharge port 52E side of the valve cylinder 52 relative to the back-pressure chamber 56, whereby pressure within the back-pressure chamber 56 can be held as the same pressure with the intermediate-pressure passage 17 side (see FIG. 2).

Accordingly, also in the fourth embodiment of the present invention, when the compressor main body 1 is started, it is possible to close the valve body 54 of the pressure retaining valve 50 and to open or close the valve body 54 according as the exhaust pressure Pa of the inlet port 52A side (the exhaust port 16) and the intermediate pressure Pb of the back-pressure chamber 56 side. Therefore, almost identical functional effects with the first embodiment can be obtained.

Further, in the valve body 54 of this embodiment, the pressure receiving area Sa of the abutting portion 54A on the inlet port 52A side is set to be smaller than the pressure receiving area Sb on the back-pressure chamber 56 side (Sb>Sa). Accordingly, as the same with the first embodiment discussed hereinbefore, by satisfying the inequality of the above-mentioned formula 7, the urging force F1 of the compression spring 58 can be set, whereby the valve body 54 of the pressure retaining valve 50 can be kept closed while the compressor main body 1 is stopped.

Next, a fifth embodiment of the present invention will be discussed hereinbelow with reference to FIG. 8. In features of the fifth embodiment, a compressor as a compressed-air source is applied to air-suspension devices of, for example, vehicles. Here, any components identical with or corresponding to those of the aforementioned first embodiment are denoted by the same reference numerals, and a detailed description thereof will be omitted below.

Figure 8:
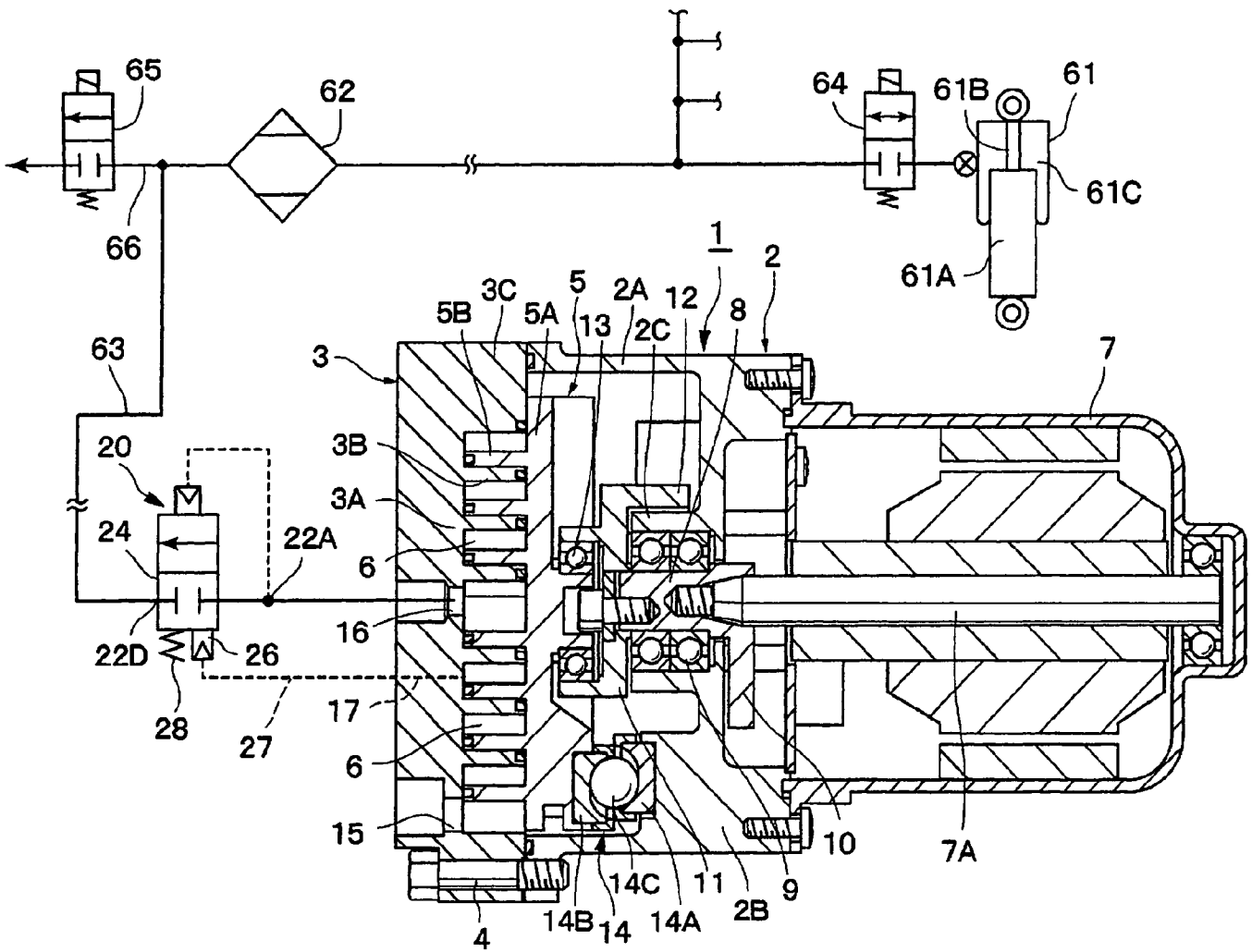
FIG. 8 is an overall schematic view showing that a compressor according to a fifth embodiment of the present invention is used as a compressed-air resource for an air-suspension.

Reference numeral 61 in FIG. 8 indicates an air-suspension mounted on a vehicle wherein the air-suspension 61 is arranged between a shaft and a body of the vehicle (either part is not shown). An air chamber 61C is, as shown in FIG. 8, formed between a cylinder 61A and a piston rod 61B. Further, compression air from the compressor main body 1 is supplied to or exhausted from the air chamber 61C via an air dryer 62, an air supply and exhaust valve 64, etc.

Here, in the air-suspension 61, according to a supply/exhaust amount of compression air, the air chamber 61C is contracted or expanded in a vertical direction, whereby a vehicle height can be adjusted by raising or lowering height of the vehicle.

Reference numeral 62 is the air dryer as an air-drying means, wherein the air dryer 62 is, as shown in FIG. 8, connected with the pressure retaining valve 20 on the compressor main body 1 side via a conduit 63. Further, the air dryer 62 installs therein, for example, a moisture absorbent (not shown). When compression air passes from the compressor main body 1 side via the later-explained conduit 63, the compression air comes into contact with the moisture absorbent installed within the air dryer 62, whereby moisture included in the compression air is absorbed by the moisture absorbent. Accordingly, dry compressed air (dry air) can be supplied to the air chamber 61C of the air-suspension 61.

On the other hand, when compressed air (exhaust air) exhausted from the air chamber 61C passes in the air dryer 62 in a reverse direction, dry compressed air reflows in the air dryer 62. Accordingly, water content absorbed into the moisture absorbent installed within the air dryer 62 can be desorbed by the dry compressed air, whereby the moisture absorbent becomes re-absorbable.

Reference numeral 63 is the conduit connected on the discharge port 22D side of the pressure retaining valve 20. The conduit 63 is applied in place of the conduit 19 discussed in the first embodiment, and connected with the discharge port 22D of the valve case 21 (the valve cylinder 22) as shown in, for example, FIG. 2. In the conduit 63, compressed air exhausted from the exhaust port 16 of the compressor main body 1 via the pressure retaining valve 20 is communicated with the air dryer 62 as shown in FIG. 8.

Reference numeral 64 is the air supply and exhaust valve provided on an outflow/inflow port side of the air-suspension 61. The air supply and exhaust valve 64 is composed of, for example, an electromagnetic valve, and normally closed so as to intercept the air chamber 61C of the air-suspension 61 from exterior. When compressed air is supplied to or exhausted from the air chamber 61C, the air supply and exhaust valve 64 is opened, whereby the air chamber 61C is contracted or expanded in a vertical direction according to supply/exhaust of the compressed air.

Reference numeral 65 is an exhaust valve connected with the air dryer 62 via an exhaust pipe 66. The exhaust valve 65 is composed of, for example, an electromagnetic valve and normally closed so as to intercept the exhaust pipe 66 from exterior. When the exhaust valve 65 is opened by means of control signals (vehicle-height adjusting signals) sent from exterior, compressed air exhausted from the air-suspension 61 side via the air dryer 62 is exhausted (discharged) into air.

Accordingly, with this fifth embodiment as discussed hereinabove, when the compressor main body 1 is started, the valve body 24 of the pressure retaining valve 20 can be closed, whereby functional effects approximately identical with the first embodiment can be obtained. Further, when the valve body 24 of the pressure retaining valve 20 is opened following start of the compressor main body 1, compressed air from the exhaust port 16 can be stably supplied to the air chamber 61C of the air-suspension 61 via the conduit 63, the air dryer 62 and the air supply and exhaust valve 64.

Still further, when the compressor main body 1 is stopped, the pressure retaining valve 20 is immediately closed enabling prevention of compressed air being reflowed from the conduit 63 side to the exhaust port 16. This contributes easy achievement of preventing the orbiting scroll 5 from conducting inverse rotation, for example. Moreover, while the compressor main body 1 is in standstill, the valve body 24 of the pressure retaining valve 20 is kept in a closed state, whereby it is possible to keep a certain pressure within the air chamber 61C of the air-suspension 61 where suitable for vehicle-height adjustment, and to prevent, for example, pressure leakage due to the pressure retaining valve 20 in a good manner.

Here, according to the fifth embodiment hereinabove discussed, the following examples are taken: the pressure retaining valve 20 is provided on the exhaust port 16 side of the compressor main body 1; and the conduit 63 is connected with on the discharge port 22D side of the pressure retaining valve 20. However, the present invention is not limited thereto, but, for example, it is possible to apply the pressure retaining valve 30, 40, 50, etc. discussed in the second to fourth embodiments as pressure retaining devices.

Furthermore, according to each of the embodiments hereinbefore discussed, the scroll compressor main body 1 where provided with the fixed scroll 3 and the orbiting scroll 5 has been exemplified. However, the present invention is not limited thereto, but, for example, it is possible to apply a scroll compressor where two scroll members facing to each other are both rotated (bin-rotation type) as a compressor main body. Another types of scroll compressor can also be, of course, applicable.

Still further, in a compressor main body applied in the present invention, it is not limited to a scroll compressor; however, for example, like a screw compressor, etc., it is possible to widely apply to a rotation compressor with an intrinsic compression ratio where, through rotating a rotation shaft by means of a driving source placed exteriorly, fluid is inhaled from an inhale port and concurrently compress the fluid, and the compressed fluid is exhausted from an exhaust port. In this case, for example, when the compressor main body is stopped, the exhaust port can be closed by means of a pressure retaining device. With this structure, problems where the compressed fluid reflows to the exhaust port, for example, can be solved.

On the other hand, according to the first embodiment hereinbefore discussed, the following structure is exemplified: by fitting the inlet port 22A of the pressure retaining valve 20 to the exhaust port 16 of the fixed scroll 3, the pressure retaining valve 20 is installed into the compressor man body 1. However, the present invention is not limited thereto, but, for example, it is possible to connect a pressure retaining device like the pressure retaining valve 20, etc. to an exhaust side of a compressor main body via pipes, etc. In this respect, the same can be said to the second to fifth embodiments.

According to each of the embodiments, the following is exemplified: between the casing 2 and the orbiting scroll 5 of the compressor main body 1, the rotation prevention device 14, so-called ball coupling, is provided. However, the present invention is not limited thereto, but, for example, a rotation prevention device composed of, for example, an auxiliary crank or Oldham's coupling can be applied.

Still further, in each of the embodiments, the compressor main body 1 for an air compressor is exemplified. However, the present invention is not limited thereto, but, for example, as compressed fluid, a variety of fluids such as nitrogen gas, helium gas, or refrigerant can be widely applied.

What is claimed is:

1. A compressor comprising:

a compressor main body in which fluid inhaled from an inhale port is compressed, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage side where communicating with the exhaust port; an urging member where normally urging the valve body into a direction to be closed; and a back-pressure means where an intermediate pressure between the inhale port and the exhaust port of the compressor main body is introduced as back pressure which affects the valve body, and wherein the valve body of the pressure retaining device is opened when a force applied to the valve body by pressure at the exhaust port is greater than another force applied to the valve body by the intermediate pressure of the back-pressure means and force by the urging member.

2. A compressor comprising:

a scroll compressor main body where, while each of lap portions for two scroll members is superimposed on each other and performs orbiting motion, fluid inhaled from an inhale port is compressed in a compression chamber, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage where communicating with the exhaust port; an urging member where normally urging the valve body into a direction to be closed; and a back-pressure means where an intermediate pressure between the inhale port and the exhaust port of the compressor main body is introduced as back pressure which affects the valve body, and wherein the valve body of the pressure retaining device is opened when a force applied to the valve body by pressure at the exhaust port is greater than another force applied to the valve body by the intermediate pressure of the back-pressure means and force by the urging member.

3. A compressor comprising:

a scroll compressor main body where, while each of lap portions for two scroll members is superimposed on each other and performs orbiting motion, fluid inhaled from an inhale port is compressed in a compression chamber, and the compressed fluid is exhausted from an exhaust port; and a pressure retaining device where provided on the exhaust port side of the compressor main body, and retaining pressure on the exhaust port side, wherein the pressure retaining device comprises: a valve body provided on a passage where communicating with the exhaust port; an urging member where normally urging the valve body into a direction to be closed; and a back-pressure means including a back-pressure chamber which applies a pressure as a back pressure to the valve body in a direction to close the valve body and a back-pressure passage which introduced an intermediate pressure between the inhale port and the exhaust port of the compressor main body into the back-pressure chamber as back pressure, and wherein the valve body of the pressure retaining device is opened when a force applied to the valve body by pressure at the exhaust port is greater than another force applied to the valve body by the intermediate pressure of the back-pressure chamber and force by the urging member.

4. The compressor according to claim 1, wherein the back-pressure means comprises: a back-pressure chamber which applies a pressure as a back pressure to the valve body in a direction to close the valve body and a back-pressure passage which introduced the intermediate pressure between the inhale port and the exhaust port of the compressor main body into the back-pressure chamber as back pressure.

5. The compressor according to claim 2, wherein the back-pressure means comprises:

a back-pressure chamber which applies a pressure as a back pressure to the valve body in a direction to close the valve body and a back-pressure passage which introduced the intermediate pressure between the inhale port and the exhaust port of the compressor main body into the back-pressure chamber as back pressure.

6. The compressor according to claim 2, wherein the two scroll members of the compressor main body comprises: a fixed scroll provided so as to fix to a tube-shaped casing; and an orbiting scroll orbitably provided within the casing so as to face the fixed scroll, wherein, between the orbiting scroll and the casing, at least three ball coupling devices are provided so as to prevent rotation of the orbiting scroll and to receive a thrust load between the orbiting scroll and the casing.

7. The compressor according to claim 3, wherein the two scroll members of the compressor main body comprises: a fixed scroll provided so as to fix to a tube-shaped casing; and an orbiting scroll orbitably provided within the casing so as to face the fixed scroll, wherein, between the orbiting scroll and the casing, at least three ball coupling devices are provided so as to prevent rotation of the orbiting scroll and to receive a thrust load between the orbiting scroll and the casing.

8. The compressor according to claim 6, wherein the pressure retaining device is structured as that the intermediate pressure as back pressure is introduced from the fixed scroll side.

9. The compressor according to claim 7, wherein the pressure retaining device is structured as that the intermediate pressure as back pressure is introduced from the fixed scroll side.

10. The compressor according to claim 6, wherein the pressure retaining device is structured at a back surface of the fixed scroll.

11. The compressor according to claim 1, wherein the valve body of the pressure retaining device is to be closed by means of the intermediate pressure and urging force of the urging member immediately after the compressor main body stops.

12. The compressor according to claim 1, wherein, immediately after the compressor main body starts, the valve body of the pressure retaining device is kept to be closed by means of the intermediate pressure and urging force of the urging member.

13. The compressor according to claim 1, wherein the compressor main body is structured as a rotary compressor where a rotating shaft is rotated by means of a driving source externally provided, so that fluid is inhaled from the inhale port and concurrently compressed, and the compressed fluid is exhausted from the exhaust port.

14. The compressor according to claim 1, wherein the valve body of the pressure retaining device is to be opened and closed based on a relation of (Pa×Sa) as force which presses the valve body in a direction to be opened and (F1+Pb×Sb) as force which presses the valve body in a direction to be closed, where pressure Pa of the compressed fluid exhausted from the exhaust port of the compressor main body is received by a pressure receiving area Sa, the intermediate pressure Pb is received by a pressure receiving area Sb, and the urging force of the urging member is set as F1.

15. The compressor according to claim 14, wherein the valve body of the pressure retaining device is structured as that the pressure receiving area Sb on the back pressure side is set to be larger than the pressure receiving area Sa of the compressed fluid.

16. The compressor according to claim 14, wherein the valve body of the pressure retaining device is structured as that the pressure receiving area Sa of the compressed fluid is set to be identical with the pressure receiving area Sb on the back pressure side.

17. The compressor according to claim 14, wherein the valve body of the pressure retaining device is structured as that the pressure receiving area Sa of the compressed fluid is set to be larger than the pressure receiving area Sb on the back pressure side.

18. The compressor according to claim 1, wherein the urging member of the pressure retaining device is structured as a spring, being placed on the back-pressure means side of and urging the valve body in a direction to be closed.

19. The compressor according to claim 1, wherein a reservoir storing the compressed fluid is connected to a downstream side of the pressure retaining device.

20. The compressor according to claim 3, wherein the pressure retaining device comprises a valve case, the valve case being provided with: a valve-body hole into which the valve body is slidably fitted; a circular valve seat where placed on an upstream side of the valve-body hole, and the valve body is attached to or detached from; an upstream passage where positioned on an upstream side of the valve seat and normally communicated with the exhaust port; and a downstream passage where positioned on a downstream side of the valve seat and communicated with or intercepted from the upstream passage by mean of the valve body, wherein the back-pressure chamber is positioned within the valve case and placed on an opposite side of the valve seat where the valve body is sandwiched between the back-pressure chamber and the valve seat, the urging member is placed within the back-pressure chamber and positioned between the valve body and the valve case, and the back-pressure passage is provided with the valve case as a passage communicating with the back-pressure chamber.

* * * * *